US011230850B2

(12) United States Patent
Tan

(10) Patent No.: US 11,230,850 B2
(45) Date of Patent: Jan. 25, 2022

(54) FORMWORK SUPPORT FORMED WITH STACKABLE COMPONENTS

(71) Applicant: SH TECHNOLOGIES PTE LTD, Singapore (SG)

(72) Inventor: Yeow Khoon Tan, Singapore (SG)

(73) Assignee: SH TECHNOLOGIES PTE LTD, Singapore (SG)

( * ) Notice: Subject to any disclaimer, the term of this patent is extended or adjusted under 35 U.S.C. 154(b) by 0 days.

(21) Appl. No.: 16/490,870

(22) PCT Filed: Jan. 15, 2018

(86) PCT No.: PCT/SG2018/050022
§ 371 (c)(1),
(2) Date: Sep. 3, 2019

(87) PCT Pub. No.: WO2018/160133
PCT Pub. Date: Sep. 7, 2018

(65) Prior Publication Data

US 2020/0002959 A1 Jan. 2, 2020

(30) Foreign Application Priority Data

Mar. 3, 2017 (SG) ..... 10201701749X

(51) Int. Cl.
*E04G 11/48* (2006.01)
*E04G 1/24* (2006.01)
(Continued)

(52) U.S. Cl.
CPC ..... *E04G 11/48* (2013.01); *E04G 1/24* (2013.01); *E04G 19/003* (2013.01); *E04G 5/004* (2013.01);
(Continued)

(58) Field of Classification Search
CPC ..... E04G 11/48; E04G 19/00; E04G 19/003; E04G 5/004; E04G 1/24; E04G 2001/248; E04G 2001/156; A47B 7/02
(Continued)

(56) References Cited

U.S. PATENT DOCUMENTS 1,639,318 A * 8/1927 Viewegh ..... A47B 7/02 248/163.1
2,874,755 A * 2/1959 Smith ..... A47C 3/04 297/183.1
(Continued)

FOREIGN PATENT DOCUMENTS

CH 334567 A * 12/1958 ..... A47B 7/02
CN 203222990 U 10/2013
(Continued)

OTHER PUBLICATIONS

International Search Report, Written Opinion, and IPRP in PCT/SG2018/050022.

*Primary Examiner* — Michael Safavi
(74) *Attorney, Agent, or Firm* — Sterne, Kessler, Goldstein & Fox P.L.L.C.

(57) ABSTRACT

The present invention relates to a formwork support comprising a stackable formwork table, at least one stackable shore and a stackable height adjustment mechanism. The stackable components are capable of saving space and improving efficiency in the assembly and disassembly of the formwork support of the present invention.

12 Claims, 5 Drawing Sheets

(51) Int. Cl.
*E04G 19/00* (2006.01)
*E04G 5/00* (2006.01)
*E04G 1/15* (2006.01)

(52) U.S. Cl.
CPC ..... *E04G 19/00* (2013.01); *E04G 2001/156* (2013.01)

(58) Field of Classification Search
USPC ..... 249/13, 18; 108/53.1, 91
See application file for complete search history.

(56) References Cited

U.S. PATENT DOCUMENTS 3,021,010 A * 2/1962 McMasters ..... A47F 7/17 211/49.1
3,180,450 A * 4/1965 Crager ..... E04G 1/24 182/14
3,326,148 A * 6/1967 Kjer Jakobsen ..... A47B 7/02 108/91
3,527,320 A 9/1970 Cunningham
3,628,805 A * 12/1971 Archer ..... B62B 3/003 280/33.998
4,679,805 A * 7/1987 Cunningham ..... B62B 3/00 108/91
4,703,702 A * 11/1987 Speicher ..... B65D 19/385 108/52.1
4,773,547 A * 9/1988 Bell ..... A47B 87/0215 108/53.1
5,613,448 A * 3/1997 Petty ..... A47B 7/02 108/91
5,715,761 A * 2/1998 Frattini ..... A47B 7/02 108/50.02
6,026,626 A * 2/2000 Fisher ..... E04C 3/08 52/28
6,082,068 A * 7/2000 Fisher ..... E04C 3/08 211/182
6,085,669 A * 7/2000 Marchand ..... A47B 7/02 108/119
6,389,988 B1 * 5/2002 Frattini ..... A47B 7/02 108/50.02
7,997,213 B1 * 8/2011 Gauthier ..... B65D 88/022 108/55.1
8,516,966 B1 * 8/2013 Evans ..... A47B 7/02 108/91
9,282,819 B2 * 3/2016 Blake ..... A01K 15/02
2008/0066659 A1 * 3/2008 Shields ..... A47B 7/02 108/91
2009/0273214 A1 * 11/2009 Shields ..... A47C 3/04 297/239
2010/0224105 A1 * 9/2010 Abel ..... E04H 1/1255 108/91
2011/0155740 A1 * 6/2011 Zintl ..... E04G 5/00 220/500
2015/0267422 A1 9/2015 Tan

FOREIGN PATENT DOCUMENTS

DE 688149 C * 2/1940 ..... A47B 7/02
DE 2206546 * 8/1973 ..... A47B 31/00
DE 2208441 * 8/1973 ..... A47B 7/02
DE 2720187 A1 * 11/1978 ..... E04G 11/48
DE 3629129 A1 3/1988
DE 10219969 * 11/2003 ..... A47B 3/0803
DE 102005005067 * 8/2005 ..... A47B 7/02
DE 102006045447 * 11/2007 ..... A47B 41/02
DE 102014112231 * 3/2016 ..... A47B 3/02
DE 202018002383 * 5/2018 ..... A47B 3/0815
FR 1461446 A * 2/1966 ..... A47B 7/02
FR 2700350 A1 * 7/1994 ..... E04G 1/34
FR 2902816 A1 * 12/2007 ..... E04G 1/24
GB 520617 A * 4/1940 ..... A47B 87/0215
GB 607373 A * 8/1948 ..... A47C 5/04
GB 640867 A * 8/1950 ..... A47B 7/02
WO 2009/127818 A1 10/2009
WO WO-2015118568 A1 * 8/2015 ..... E04G 1/28

* cited by examiner

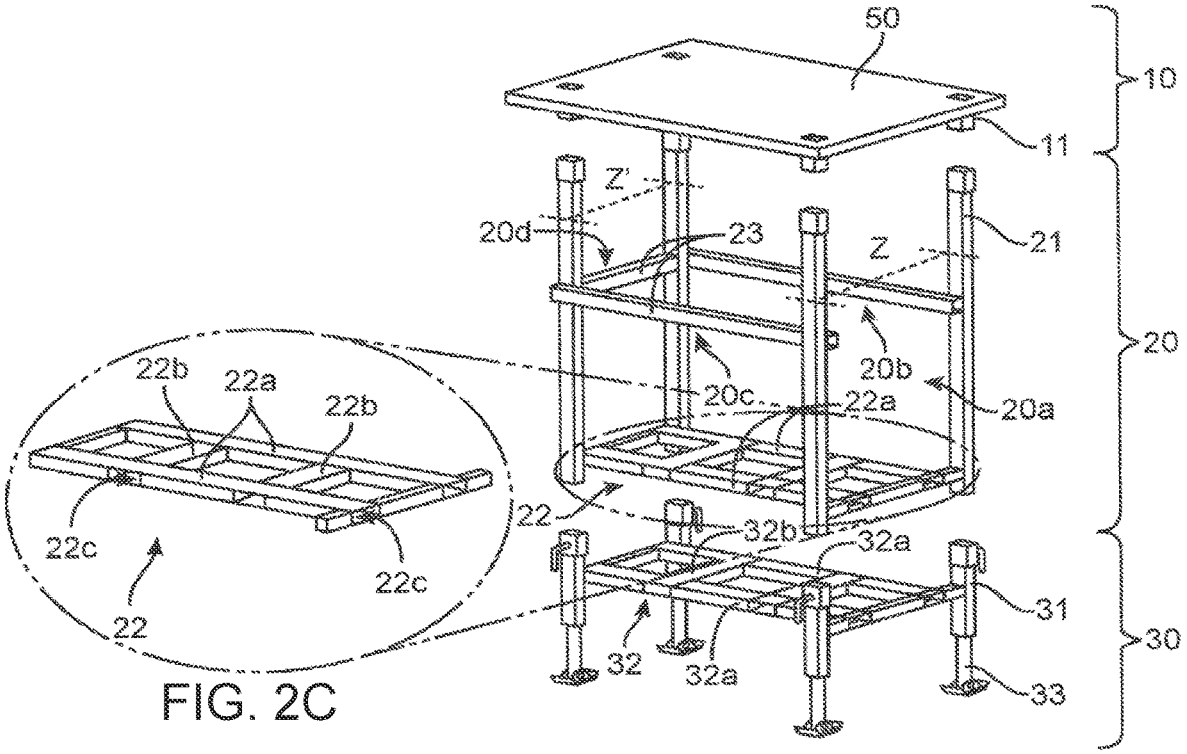
FIG. 2C
FIG. 2A
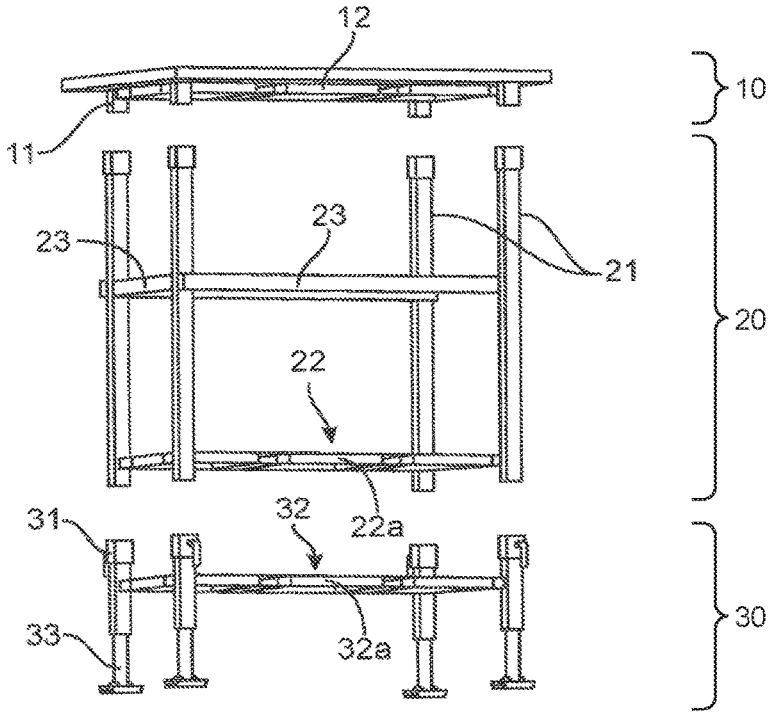
FIG. 2B

FORMWORK SUPPORT FORMED WITH STACKABLE COMPONENTS

FIELD OF INVENTION

The present invention relates to formwork support for use in the building and/or construction industry, and in particular to formwork support that can be stacked and stored when not in operation.

BACKGROUND ART

The following discussion of the background to the invention is intended to facilitate an understanding of the present invention only. It should be appreciated that the discussion is not an acknowledgement or admission that any of the material referred to was published, known or part of the common general knowledge of the person skilled in the art in any jurisdiction as at the priority date of the invention.

Formwork supports are temporary support structures used in the building and construction industry. Formwork supports typically comprise shores and formwork tables for carrying personnel and equipment for construction purposes, for example concreting of a ceiling. Dismantling a system of formwork supports is labour intensive and can pose safety threats, especially if the various components of the formwork supports are not well fixed and are loose where such components may dislodge and fall from a height, thereby injuring personnel. Substantial man hours are also consumed in the disassembly a formwork support into its various components, e.g. shores and formwork table, and subcomponents, e.g. support trusses, bracings, nuts and bolts, for the purposes of storage. In addition, while formwork supports can be disassembled to their various components for storage, such storage is still space consuming and there is always a possibility of losing a particular component/subcomponent. Assembling a disassembled formwork support requires a substantial amount of time and manpower, which reduces efficiency in deploying formwork supports for commencement of construction and building work.

U.S. Pat. No. 6,161,359 discloses a collapsible shore that can be used in a formwork support, where the shore can be folded to a compact state for storage. However the shore of U.S. Pat. No. 6,161,359 comprises complex movable components that interact with one another to enable the shore to fold and unfold. Further, upon unfolding, these various components have to be properly secured to ensure that the shore does not collapse when in use which could cause substantial injury. Furthermore, the unfolding of the shore requires the use of a crane which may not be present at every construction and building site. Therefore the unfolding and deployment of the shore of U.S. Pat. No. 6,161,359 still requires substantial amount of time and there is also the risk that the shore may collapse when in use.

Therefore, there exists a need for a better solution to ameliorate the aforementioned problems. In particular, there exists a need for an improved formwork support and components which are easily stored and deployed, requires less space when stored, and has a low risk of collapse during use.

SUMMARY OF THE INVENTION

The present invention seeks to address and/or ameliorate the problems in the prior art by providing formwork supports and components that are easily stored and deployed thereby saving time, require less space when stored thereby saving costs, and have a low risk of collapse during use.

According to an aspect of the present invention, there is a shore comprising a plurality of truss frames arranged to define an opening, wherein the shore is proportioned to laterally receive another shore via the opening.

According to another aspect of the present invention, there is a method of stacking and storing shores according to any one of claims 1 to 16, the method comprising (a) engaging a shore with a lifting means; and (b) laterally moving the shore into another shore via its opening for stacking and storage.

According to another aspect of the present invention, there is a method of erecting a formwork support comprising at least one shore according to any one of claims 1 to 16, the method comprising: (a) engaging a shore with a lifting means; and (b) lifting and engaging the shore via its base portion to a top portion of another shore.

According to another aspect of the present invention, there is a stackable shore height adjustment mechanism comprising a truss frame adapted to connect height adjustment landing legs, wherein the truss frame is adapted to be engaged by a lifting means for lifting and stacking the mechanism over another mechanism.

According to another aspect of the present invention, there is a stackable formwork table comprising a platform and at least one support adapted to fit into a support engagement portion arranged on a top surface of the platform of another formwork table.

According to another aspect of the present invention, there is a formwork support comprising a shore according to an aspect of the present invention, a height adjustment mechanism according to an aspect of the present invention, and a formwork table according to an aspect of the present invention.

Other aspects of the invention will become apparent to those of ordinary skill in the art upon review of the following description of specific embodiments of the invention in conjunction with the accompanying figures.

BRIEF DESCRIPTION OF THE DRAWINGS

The present invention will now be described, by way of example only, with reference to the accompanying drawings, which are for illustrative purposes only and are therefore not drawn to scale, in which:

FIG. 2A illustrates a disassembled formwork support in accordance with an embodiment of the present invention.

FIG. 2B illustrates the disassembled formwork support in FIG. 2A.

FIG. 2C illustrates a shore lifting engagement means viewed seperately from the formwork support in FIG. 2A in accordance with an embodiment of the present invention.

DESCRIPTION OF EMBODIMENTS OF THE INVENTION

Figure 1A:
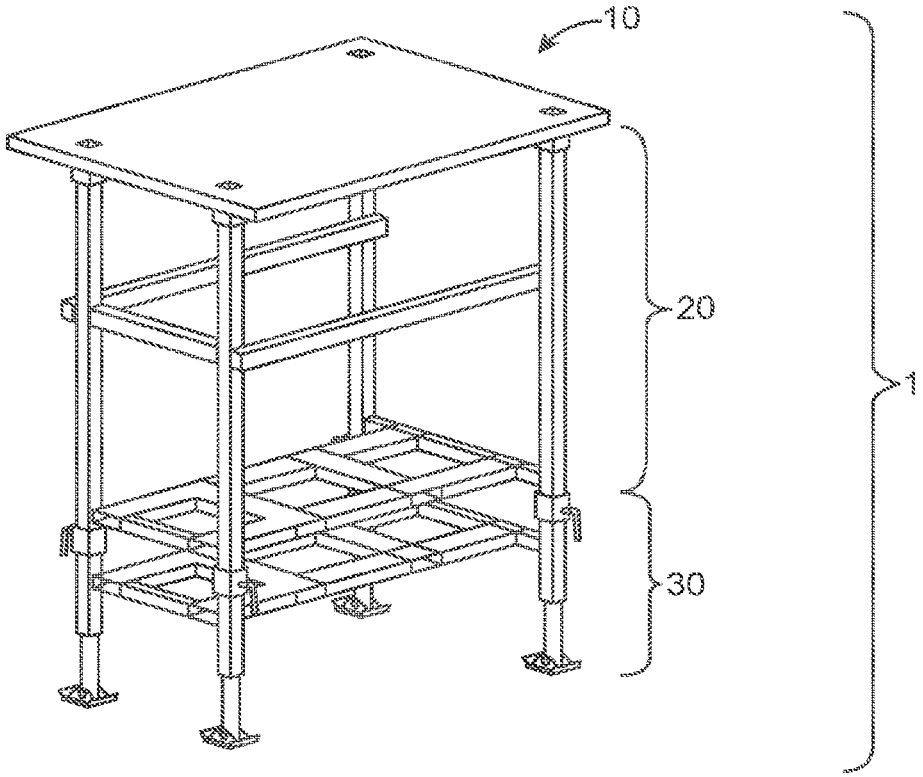
FIG. 1A illustrates an assembled formwork support in accordance with an embodiment of the present invention.

Particular embodiments of the present invention will now be described with reference to the accompany drawings. The terminology used herein is for the purpose of describing particular embodiments only and is not intended to limit the scope of the present invention. Other definitions for selected terms used herein may be found within the detailed description of the invention and apply throughout the description. Additionally, unless defined otherwise, all technical and scientific terms used herein have the same meanings as commonly understood by one or ordinary skill in the art to which this invention belongs. Where possible, the same reference numerals are used throughout the figures for clarity and consistency.

Throughout the specification, unless the context requires otherwise, the word "comprise" or variations such as "comprises" or "comprising, will be understood to imply the inclusion of a stated integer or group of integers but not the exclusion of any other integer or group of integers.

Furthermore, throughout the specification, unless the context requires otherwise, the word "include" or variations such as "includes" or "including" will be understood to imply the inclusion of a stated integer or group of integers but not the exclusion of any other integer or group of integers.

As used throughout the specification, the terms "top" and "bottom" will be taken with reference to a ground level on which the shore of the present invention is installed, used and/or stored. Therefore a "top" portion of a shore is the portion of the shore furthest from the ground level.

As used throughout the specification, the term "opposite" includes substantially opposite and is not limited to parallel objects, i.e. objects may be considered opposite one another even though they are not parallel but are angled with respect to one another.

As used throughout the specification, the terms lifting means include mechanism or machinery such as "forklift", "lift truck" and the like used throughout the specification herein refer to any type of forklift truck, or any other similar machinery known in the art which is adapted for lifting application.

Figure 1B:
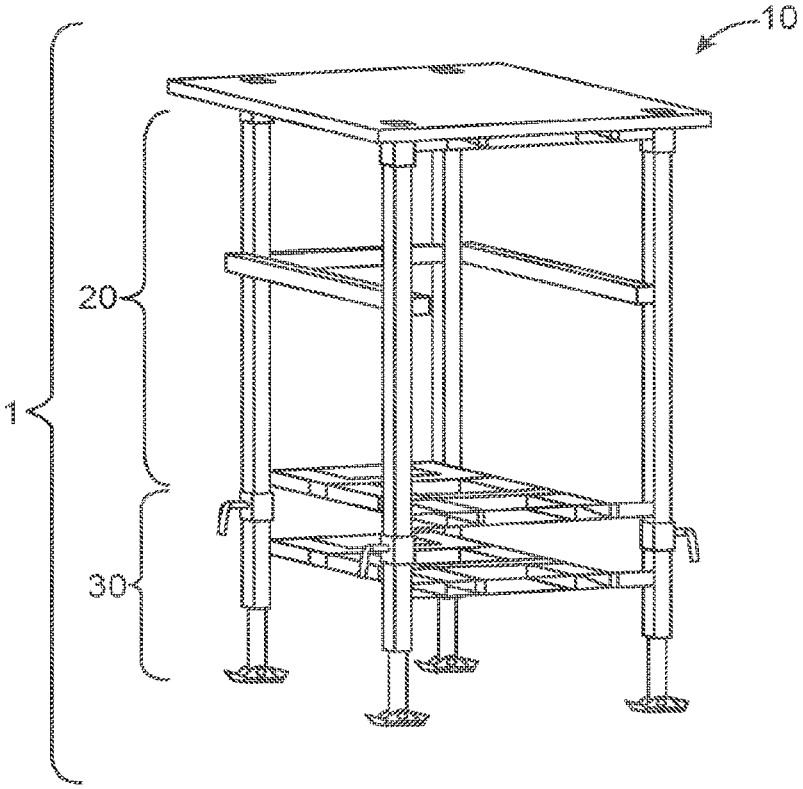
FIG. 1B illustrates the assembled formwork support in FIG. 1A.

In accordance with an aspect of the present invention, FIGS. 1A and 1B provide a formwork support 1 comprising a formwork table 10, a shore 20, and a height adjustment mechanism 30 (the three main components). The formwork support 1 can cooperate and/or be coupled to other formwork supports in a system of formwork supports to provide a desired coverage for a building and construction task. Coupling more than one formwork support 1 provides additional stability when in use. The coupling of more than one formwork support 1 may be in accordance with the shape of the area where work is conducted. The assembly, disassembly and movement of the formwork support 1 can be operated by a lifting means, preferably a fork lift.

The disassembly and assembly of the formwork support 1 is simple and time efficient due to the handling of three main components. Further as the sub-components (as explained below) of the main components are fixed and secure, the assembly, disassembly and operation of the formwork support 1 is safe. Furthermore, each main component is capable of between stacked together when stored, thereby saving storage space and time when assembly of the formwork support 1 is required.

With reference to FIGS. 2A and 2B, formwork table 10 comprises a platform 50, table supports 11 and table lifting engagement means 12; shore 20 comprises shore supports 21, shore lifting engagement means 22 and shore intermediate braces 23; and height adjustment mechanism 30 comprises one or more adjustment supports 31, adjustment lifting engagement means 32, and landing legs 33. The supports 11, 21, 31 are vertical or substantially vertical, and are shaped and sized to cooperate and mate with one another in the assembly of formwork support 1. In various embodiments, the assembled formwork support 1 can comprise more than shore 20, for example there are two shores 20 between the formwork table 10 and height adjustment mechanism 30, where the shores 20 engage one another via shore supports 21. The engagement of supports 11, 21, 31 comprises releasable engagement means known in the art, for example, the base portion of table support 11 comprises a male portion adapted to be received by and mate with a female portion of a top portion of shore support 21, where the mating can be secured with a removable cross-pin inserted into and across the connection between the two supports 11, 21. Other releasable engagement means include but are not limited to nuts, bolts, screws and latches.

Formwork Table

The platform 50 can be any shape and size depending on the application. Preferably, the platform 50 has a polygonal shape and more preferably a rectangular or square shape. The table supports 11 are attached to a bottom surface of the platform 50 and the number of table supports 11 depends on the application and requirements and would correspond with the number of supports 21, 31 in the shore 20 and height adjustment mechanism 30. Preferably there are four table supports 11. The table supports 11 can be of any length depending on the application and requirements in relation to the height of the formwork table 10.

The platform 50 comprises a top surface 50*a* which defines the working area where personnel and equipment are supported. The table lifting engagement means 12 is disposed between the table supports 11, and is attached to the bottom surface of the platform 50. In various embodiments, the table lifting engagement means 12 is attached to a separate support brace attached to the bottom surface of the platform 50, where the support brace provides additional rigidity and stability to the formwork table 10 and/or platform 50.

The table lifting engagement means 12 is shaped and adapted for a portion of a lifting means, such as one or more forks of a forklift, to engage the same. As illustrated, the table lifting engagement means 12 comprises a pair of longitudinal hollow braces 12*a* that runs substantially along the length of the formwork table 10, and a pair of cross hollow braces 12*b* that ran substantially along the width of the formwork table 10, between the longitudinal hollow braces 12*a*. The longitudinal and cross hollow braces 12*a*, 12*b* are preferably aligned transversely with respect to one another. In various embodiments, the longitudinal and cross hollow braces 12*a*, 12*b* are discrete components, e.g. the longitudinal hollow braces 12*a* may be positioned on top of the cross hollow braces 12*b*.

The braces 12*a*, 12*b* are sized and shaped to receive the lifting means, e.g. a fork of a forklift, via openings 12*c*. The interior hollow portions of the longitudinal and cross hollow braces 12*a*, 12*b* may be interconnected. The longitudinal and cross hollow braces 12*a*, 12*b* permit the engagement and lifting of the formwork table 10 by a lifting means at two possible directions, for example lateral direction A via the longitudinal hollow braces 12*a* and lateral direction A' via the cross hollow braces 12*b* as shown in FIG. 3B.

The table supports 11 and table lifting engagement means 12 are preferably fixed, for example by welding, bolting and riveting, to the platform 50. This improves the safety in the handling of the formwork table 10 since there will not be potentially loose components that may detach during assembly, disassembly and operation of the formwork support 1. In other embodiments, the table supports 11 and table lifting engagement means 12 may be integrally formed with the platform 50.

Figure 3A:
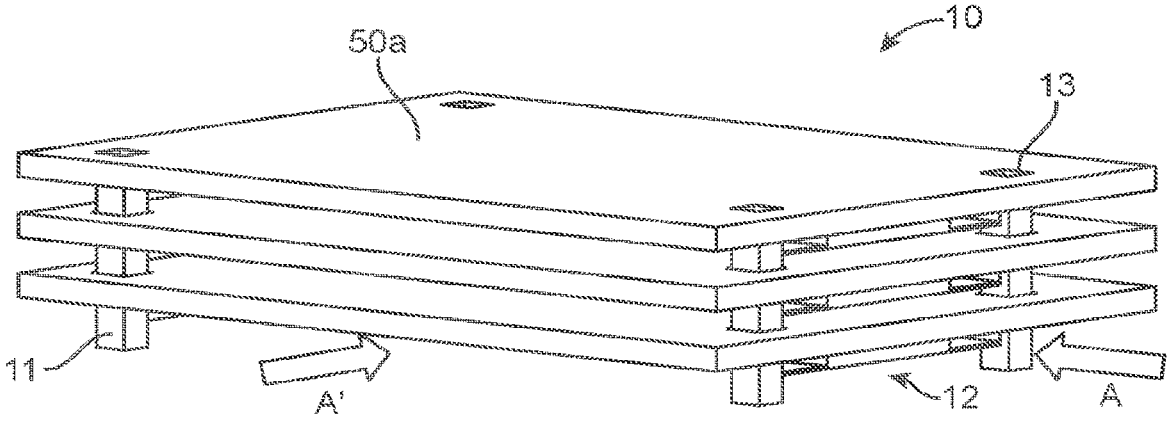
FIG. 3A illustrates a stack of formwork tables in accordance with an embodiment of the present invention.
Figure 3B:
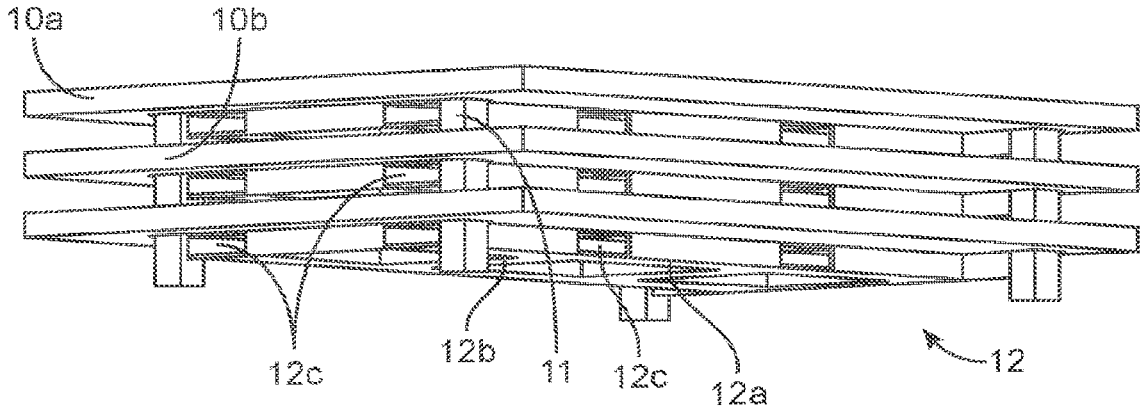
FIG. 3B illustrates the stack of formwork tables in FIG. 3A.

For storage and as shown in FIGS. 3A and 3B, formwork tables 10 are adapted to be stacked on top on one another to save space. Each formwork table 10 comprises a support engagement portion 13 formed on the top surface 50*a* of the platform 50, where the support engagement portion 13 is coincident with each table support 11. When stacked, each table support 11 of one formwork table 10*a* fits into the support engagement portion 13 of another formwork table 10*b* such that the stacked formwork tables 10 are securely and safely stacked on top of one another. This arrangement allows for a large number of formwork tables 10 to be stacked on top of one another.

Shore

The shore supports 21 are vertical or substantially vertical, and the shore intermediate braces 23 are horizontal or substantially horizontal. The shore intermediate braces 23 connect the shore supports 21 together. Preferably the intermediate braces 23 are joined to the shore supports 21 at substantially middle portions of the shore supports 21. However it will be appreciated that the intermediate braces 23 can be joined to the shore supports 21 at or near one of their ends.

The shore supports 21 are arranged such that the shore 20 has a substantially cuboidal shape, which corresponds to the shape of the platform 50. In various embodiments, the shore 20 can have other shapes, for example a hexagonal prismatic shape. The number of shore supports 21 will depend on the shape of the shore 20. Preferably there are four shore supports 21. The shore supports 21 can be of any length depending on the application and requirements in relation to the height of the shore 20.

Figure 4A:
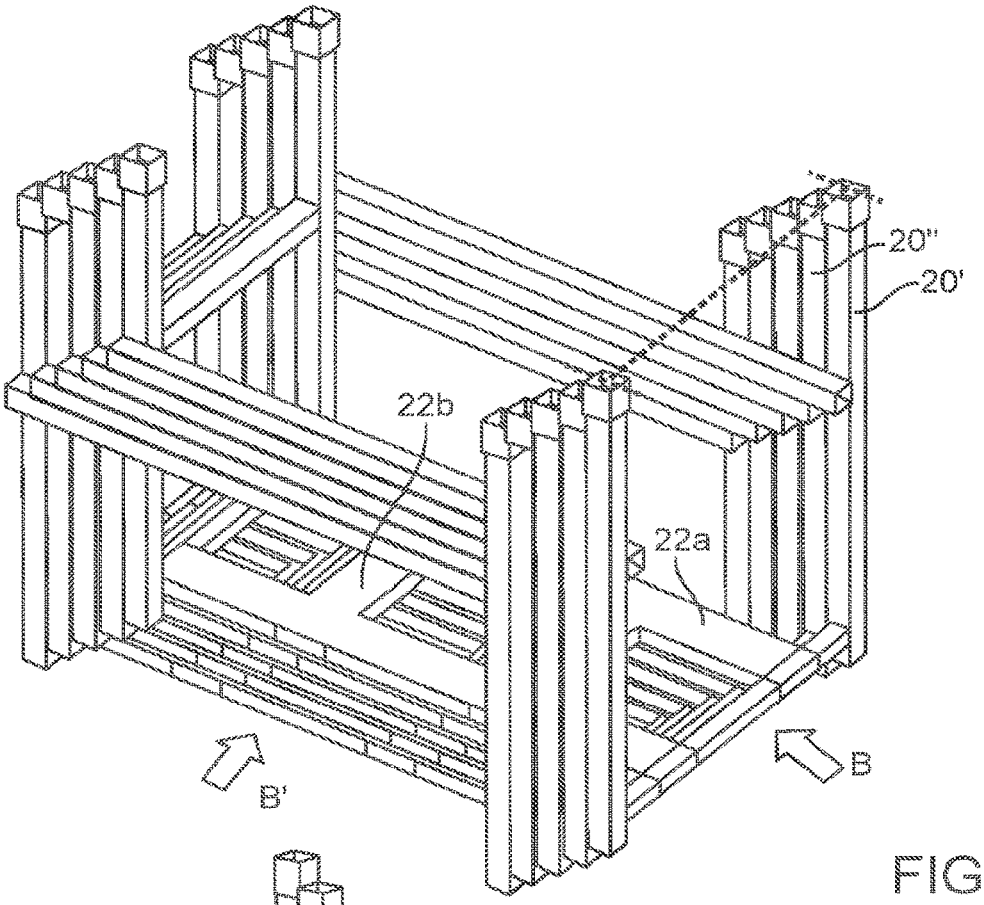
FIG. 4A illustrates a stack of shores in accordance with an embodiment of the present invention.
Figure 4B:
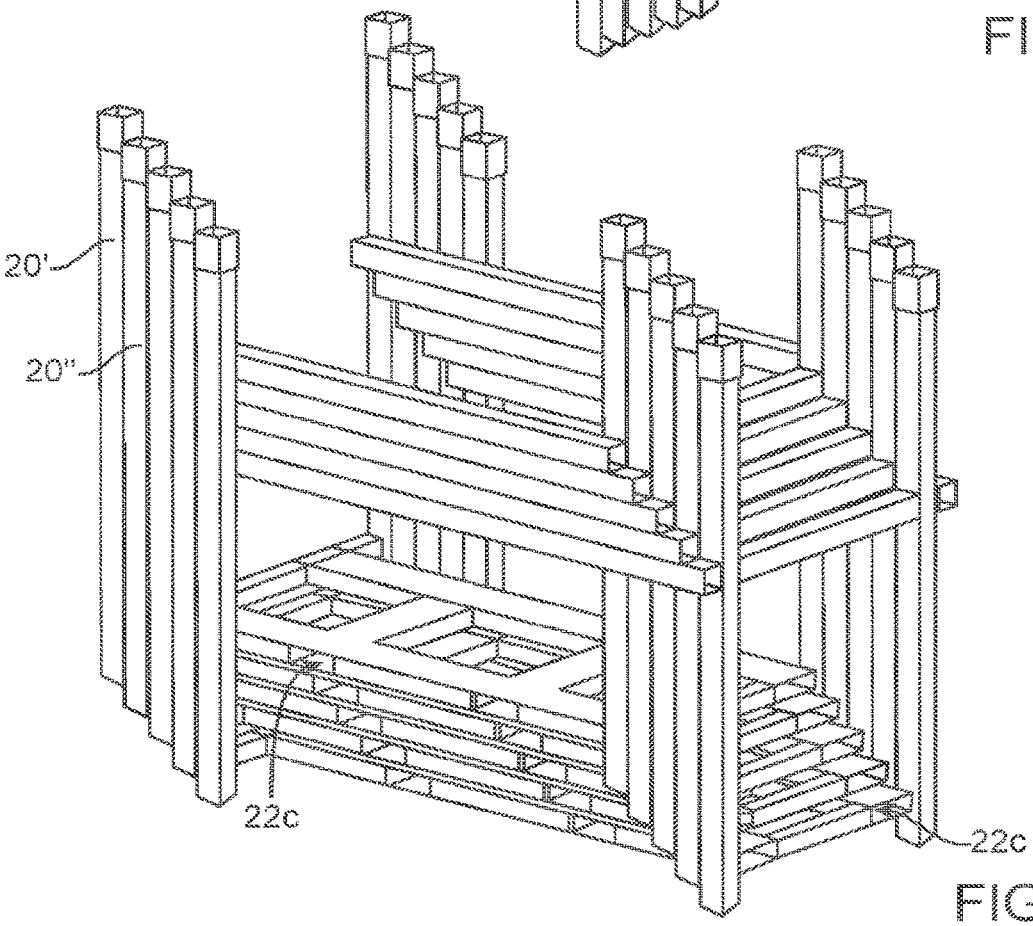
FIG. 4B illustrates the stack of shores in FIG. 4B.

As shown in FIGS. 2A and 2B, the intermediate braces 23 join the shore supports 21 to define a first truss frame 20*b*, a second truss frame 20*c* and third truss frame 20*d*, where the first truss frame 20*b* is arranged opposite the second truss frame 20*c*, and the third truss frame 20*d* connect the first and second truss frames 20*b*, 20*c*, preferably via one of their ends. The truss frames 20*b*, 20*c*, 20*d* share shore supports 21. Opposite the third truss frame 20*d*, is an opening 20*a*, where there is no intermediate brace 23. As shown in FIGS. 4A and 4B, opening 20*a* remains as an opening during storage of shores 20 and allows a shore 20 to receive another shore 20 via said opening. The opening 20*a* can be closed with a detachable intermediate brace (not shown), defining a fifth truss frame during operation of the shore 20. This detachable intermediate brace adds support and stability to the shore 20 when in use.

The first and second truss frames 20*b*, 20*c* are angled to taper from the opening 20*a* towards the third truss frame 20*d*. Such tapering can be achieved by placing the shore supports 21 defining the third truss frame 20*d* closer together compared to the shore supports 21 defining the opening 20*a*, where one end of the intermediate braces 23 of the first and second truss frame 20*b*, 20*c*, is connected to an outer portion of the shore supports 21 at the third truss frame 20*d*, and the other end is connected an inner portion of the shore supports 21 at the opening 20*a*. With reference to FIG. 2A, distance Z' is smaller than distance Z. Such tapering provides a guide to place one shore 20 into an internal space of another shore 20 via opening 20*a* during storage.

The shore lifting engagement means 22 is located at a portion, such as a base portion or a region proximate the base portion of the shore 20 (i.e. base portions of the first, second and third truss frames 20*b*, 20*c*, 20*d*) as shown in FIG. 2 and connects the shore supports 21 via one of their ends. The shore lifting engagement means 22 is shaped and adapted for a portion of a lifting means to engage. In some embodiments, the shore lifting engagement means 22 is similar to the table lifting engagement means 12, and is horizontal or substantially horizontal. The shore lifting engagement means 22 also comprises a pair of longitudinal hollow braces 22*a* that runs substantially along the length of the shore 20, and a pair of cross hollow braces 22*b* that ran substantially along the width of the shore 20, between the longitudinal hollow braces 22*a*. The longitudinal and cross hollow braces 22*a*, 22*b* are preferably aligned transversely with respect to one another. In various embodiments, the longitudinal and cross hollow braces 22*a*, 22*b* are discrete components, e.g. the longitudinal hollow braces 22*a* may be positioned on top of the cross hollow braces 22*b*. In various embodiments, the shore lifting engagement means 22 is attached to a separate support brace (e.g. a fourth truss frame) that connects the shore supports 21 together, where such support brace provides additional rigidity and stability to the shore 20.

In some embodiments, the shore lifting engagement means 22 is adjustable along the length of the supports 21.

The braces of the shore lifting engagement means 22 are sized and shaped to receive a lifting means, e.g. a fork of a forklift, via openings 22*c*. The interior hollow portions of the longitudinal and cross hollow braces 22*a*, 22*b* may be interconnected. The longitudinal and cross hollow braces 22*a*, 22*b* permit the engagement and lifting of the shore 20 by a lifting means from at least two separate directions, for example lateral direction B via the longitudinal hollow braces 22*a* and lateral direction B' via the cross hollow braces 22*b* as shown in FIG. 4A.

The shore supports 21, intermediate braces 23 and shore lifting engagement means 22 are preferably fixed, for example by welding, bolting and riveting, to one another. This improves the safety in the handling of the shore 20 since there will not be potentially loose components that may detach during assembly, disassembly and operation of the formwork support 1.

For storage as shown in FIGS. 4A and 4B, shores 4 are adapted to cooperate and be stacked together to significantly save space. In contrast, certain prior art structures cannot cooperate with one another during storage, thereby creating void spaces and wasting space. Other prior art structures may be collapsible but additional steps have to be taken to collapse such structure prior to storage. Moreover, assembly of such collapsible structure involves additional unfolding and securing steps before they can be safely used in building and construction work, thereby requiring additional time at preparation and deployment stages.

In contrast, each shore 20 can be inserted into an internal area defined by the shore supports 21, shore lifting engagement means 22 and shore intermediate braces 23, via opening 20*a*. The insertion of one shore 20' into another shore 20" is via a lateral movement of the shore 20' through the opening 20*a* of shore 20". This is achieved by a lifting means engaging shore 20' via the shore lifting engagement means 22, and lifting and actuating the shore 20' in a lateral direction B. Adjustment of the positions of the shores 20 with respect to one another can be achieved by a lifting means engaging the shore engagement lifting means 22 via a lateral direction B' and actuating the shores 20 further in the lateral direction B. In storage, adjacent shores 20 are preferably in contact with one another, e.g. adjacent shore supports 21 are in lateral contact with one another and adjacent shore intermediate braces 23 and shore lifting engagement means 22 are on top of one another. Preferably, more than five shores 20 can be stacked and stored together.

Height Adjustment Mechanism

The height adjustment mechanism 30 comprises adjustment supports 31 that correspond to the shore supports 21. Therefore the shape of the height adjustment mechanism 30 preferably corresponds substantially to the shape of the shore 20. Preferably there are four adjustment supports. The adjustment supports 31 can be of any length depending on the application and requirements in relation to the height of the height adjustment mechanism 30.

The adjustment lifting engagement means 32 connects the adjustment supports 31 together. The adjustment lifting engagement means 32 is similar to the shore lifting engagement means 22 and the table lifting engagement means 12, and is horizontal or substantially horizontal. The adjustment lifting engagement means 32 also comprises a pair of longitudinal hollow braces 32*a* that runs substantially along the length of the height adjustment mechanism 30, and a pair of cross hollow braces 32*b* that ran substantially along the width of the height adjustment mechanism 30, between the longitudinal hollow braces 32*a*. The longitudinal and cross hollow braces 32*a*, 32*b* are preferably aligned transversely with respect to one another. In various embodiments, the longitudinal and cross hollow braces 32*a*, 32*b* are discrete components, e.g. the longitudinal hollow braces 32*a* may be positioned on top of the cross hollow braces 32*b*. In various embodiments, the adjustment lifting engagement means 32 is attached to a separate support brace (e.g. a truss frame) that connects the adjustment supports 31 together, where such support brace provides additional rigidity and stability to the height adjustment mechanism 30.

The braces of the adjustment lifting engagement means 32 are sized and shaped to receive a lifting means, e.g. a fork of a forklift, via openings 32*c*. The interior hollow portions of the longitudinal and cross hollow braces 32*a*, 32*b* may be interconnected. The longitudinal and cross hollow braces 32*a*, 32*b* permit the engagement and lifting of the height adjustment mechanism 30 by a lifting means at two separate directions, for example lateral direction C via the longitudinal hollow braces 32*a* and lateral direction C' via the cross hollow braces 32*b* as shown in FIG. 5A.

The adjustment supports 31 and adjustment lifting engagement means 32 are preferably fixed, for example by welding, bolting and riveting, to one another. This improves the safety in the handling of the height adjustment mechanism 30 since there will not be potentially loose components that may detach during assembly, disassembly and operation of the formwork support 1.

The landing legs 33 are telescopic with respect to the adjustment supports 31. The landing legs 33 are capable of retracting into and extending out of adjustment supports 31. The actuation of the landing legs 31 into and out of the adjustment supports may be provided by various actuators known in the art. Preferably, the actuator is a geared mechanism that can adjust, via a rotation of winch 34, the height of the landing leg 33 without the use of substantive force. The extension and retraction of the landing legs 33 allow for the adjustment of the height of the formwork support 1, and adapts the formwork support to sloping or uneven floor surfaces. The landing legs 33 can be of any length depending on the application and requirements in relation to the height of the height adjustment mechanism 30. The landing legs 33 comprise flat plates at the end where the landing legs 33 contact a ground surface, where the flat plates increases surface contact and improves the stability of the formwork support 1 during operation.

Figure 5A:
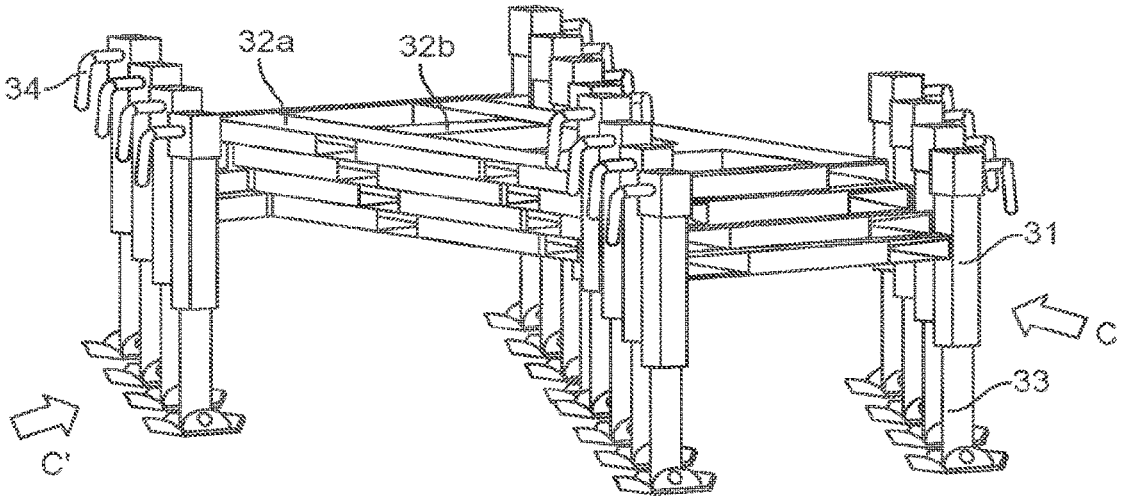
FIG. 5A illustrates a stack of height adjustment mechanism in accordance with an embodiment of the present invention.
Figure 5B:
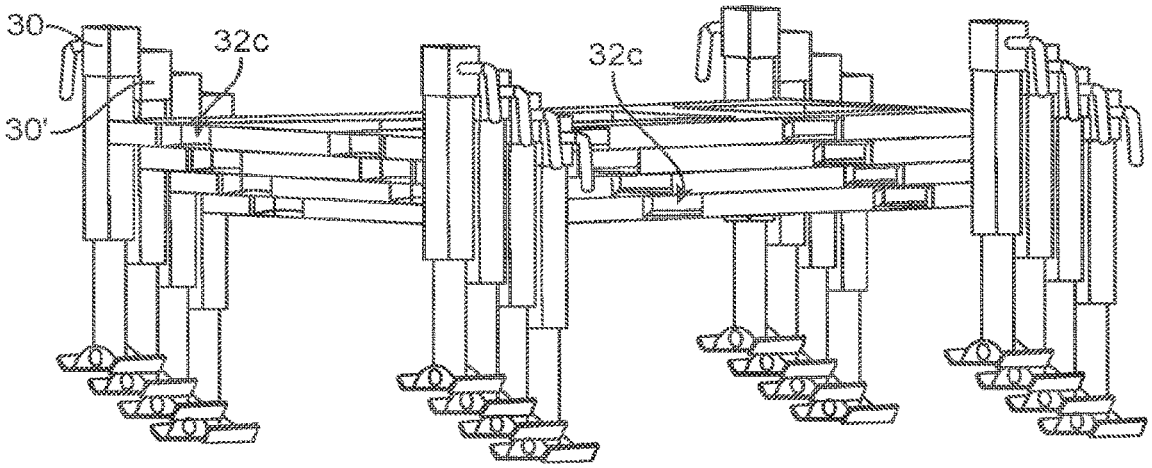
FIG. 5B illustrates the stack of height adjustment mechanism in FIG. 5A.

For storage and as shown in FIGS. 5A and 5B, height adjustment mechanisms 30 are adapted to cooperate and be stacked on top of one another to significantly save space. The placement of one height adjustment mechanism 30 on top of another is achieved by a lifting means engaging height adjustment mechanism 30 via the adjustment lifting engagement means 32, lifting the height adjustment mechanism 30 over height adjustment mechanism 30', and lowering the height adjustment mechanism 30 on top of height adjustment mechanism 30'. Adjustment of the height adjustment mechanisms 30 with respect to one another can be achieved by a lifting means engaging the adjustment engagement lifting means 32 via a lateral direction C and/or C'. In storage, adjacent height adjustment mechanism 30 are in contact with one another, e.g. adjacent adjustment supports 31 are in lateral contact with one another and adjacent adjustment lifting engagement means 32 are on top of one another. The landing legs 33 may be remain extended or be retracted when in storage.

In various embodiments, the height adjustment mechanism is integral with shore 20 where the landing legs 33 extend and retract from shore supports 21. In such embodiments, only either the shore lifting engagement means 22 or the adjustment lifting engagement means 32 is required.

Method of Assembly and Disassembly

With reference to FIGS. 1A, 1B, 2A and 2B, the formwork support 1 is easily assembled and disassembled, where after disassembly, the components of the formwork support 1 can be easily and efficiently stored.

Prior to assembly, a formwork table 10 is removed from a stack of formwork tables (FIGS. 3A and 3B), one or more shores 20 is removed from a stack of shores (FIGS. 4A and 4B), and a height adjustment mechanism 40 is removed from a stack of height adjustment mechanisms (FIGS. 5A and 5B). The formwork table 10, shore 20 and height adjustment mechanism 30 are engaged via a lateral direction at their lifting engagement means 12, 22, 32 by a lifting means, such as a forklift.

During assembly, formwork table 10 is placed on top of and engaged to shore 20 via supports 11, 21. The shore 20 is in turn placed on top of and engaged to height adjustment mechanism 20 via supports 21, 31. The engagement between the formwork table 10, shore 20 and height adjustment mechanism 30 can be achieved by interlocks known in the art, for example cross-pins and nuts and bolts. In various embodiments, the shore 20 can be placed first on the height adjustment mechanism 30 before the formwork table 10 is placed on top of the shore 20.

To adjust the height of the formwork table 1, the assembly method further comprises adjusting the height of the height adjustment mechanism 30 through the extension and retraction of the landing leg 33, for example by operating winch 34.

To disassemble formwork support 1 for storage, the formwork table 10, shore 20 and height adjustment mechanism 30 are disengaged and separated from one another. Such disengagement and separation is achieved via lifting means that engage at a lateral direction of their lifting engagement means 12, 22, 32.

After separation, the formwork table 10 is stacked with other formwork tables 10 as shown in FIGS. 3A and 3B, where the table supports 11 fit and rest in support engagement portions 13. The shore 20 is actuated in a lateral direction through an opening 20*a* and into an internal space of another shore 20 for stacking as shown in FIGS. 4A and 4B. The height adjustment mechanism 30 is lifted and placed on top of another height adjustment mechanism 30 as shown in FIGS. 5A and 5B. Accordingly, there will be three clearly separated stacks of formwork support components which improves logistical efficiency and reduces the possibility of components/sub-components from being misplaced.

It will be appreciated by the person skilled in the art that variations and combinations of features described above, not being alternatives or substitutes, may be combined to form yet further embodiments falling within the intended scope of the invention. In particular, The cross-sectional area of the supports and braces can comprise any shape including but not limited to polygonal, circular and triangular.

The materials for forming the various formwork support components include but are not limited to metal, wood and plastic, or a composite thereof.

There may be more than one intermediate braces connecting the shore supports.

The cross hollow braces may be replaced with apertures/openings in the longitudinal hollow braces, in a direction that is transverse the length of the longitudinal hollow braces.

The invention claimed is:

1. A shore comprising:

a frame including:

a first truss frame including:

a first shore support;

a second shore support; and a first intermediate brace connecting the first shore support and the second shore support;

a second truss frame including:

a third shore support;

a fourth shore support; and a second intermediate brace connecting the third shore support and the fourth shore support; and a third truss frame including:

a third intermediate brace coupled between the first shore support and the third shore support;

wherein the third truss frame is defined by the first shore support, the third shore support and the third intermediate brace;

wherein the first, the second and the third truss frames define a space bounded thereby;

wherein the second shore support and the fourth shore support define an opening therebetween; and shore lifting engagement means connected to the frame, wherein the shore lifting engagement means is adapted to laterally receive a lifting means for lifting the shore;

wherein the lifting means is capable of being laterally received adjacent the opening such that the shore is capable of being lifted and moved in a manner so as to be laterally and substantially received into the space of an identical shore via the opening of the identical shore.

2. The shore according to claim 1, wherein when received into the space of the identical shore, the third truss frame of the shore abuts the third truss frame of the identical shore.

3. The shore according to claim 2, wherein when received into the space of the identical shore, the first intermediate brace and the second intermediate brace of the shore are supported by the first intermediate brace and the second intermediate brace of the identical shore respectively.

4. The shore according to claim 1, wherein the first and second intermediate braces are at least substantially parallel.

5. The shore according to claim 4, wherein each of the first, second, third and fourth shore supports comprises a vertical support.

6. The shore according to claim 5, wherein each of the first intermediate brace and the second intermediate brace includes an inward-facing surface and an outward-facing surface opposite the inward-facing surface; and wherein the first shore support and the third shore support are connected to the inward-facing surface of one end of their respective intermediate brace; and the second shore support and the fourth shore support are connected to the outward-facing surface of another end of their respective intermediate brace.

7. The shore according to claim 5, wherein the first and second intermediate braces are horizontal braces.

8. The shore according to claim 1, wherein the shore lifting engagement means comprises a pair of hollow braces coupled between the third truss frame and the second shore support and the fourth shore support, each of the hollow braces having an opening at an end thereof between the second shore support and fourth shore support for receiving the lifting means.

9. The shore according to claim 8, wherein each of the pair of hollow braces further comprises at least one opening defined in its side for receiving the lifting means.

10. The shore according to claim 9, wherein the at least one opening includes a pair of spaced apart openings.

11. The shore according to claim 1, wherein the shore is capable of being detachably coupled to a height adjustment mechanism, and wherein the height adjustment mechanism is at a base portion of the shore, and wherein the height adjustment mechanism comprises a height adjustable landing leg.

12. The shore according to claim 1, the shore further comprising a fourth intermediate brace that is detachably connected between the second shore support and the fourth shore support to close the opening when in operation.

* * * * *